United States Patent [19]

Kurematsu et al.

[11] Patent Number: 4,941,006

[45] Date of Patent: Jul. 10, 1990

[54] AUTOMATIC PROCESSOR

[75] Inventors: Masayuki Kurematsu; Shigeharu Koboshi; Nobutaka Goto, all of Hino; Masayuki Naoi; Yasuhiro Fujisawa, both of Yokohama, all of Japan

[73] Assignee: Konica Corporation, Tokyo, Japan

[21] Appl. No.: 311,520

[22] Filed: Feb. 15, 1989

[30] Foreign Application Priority Data

Feb. 19, 1988 [JP] Japan ..... 63-36798

[51] Int. Cl.[5] ..... G03D 3/06; G03D 3/08

[52] U.S. Cl. ..... 354/299; 354/322; 354/324; 354/330

[58] Field of Search ..... 354/299, 320, 322, 324, 354/330

[56] References Cited

U.S. PATENT DOCUMENTS

| | | | |
|---|---|---|---|
| 3,839,726 | 10/1974 | Reichardt | 354/299 |
| 4,112,453 | 9/1978 | Hutchison | 354/330 |
| 4,160,153 | 7/1979 | Melander | 354/299 |
| 4,188,106 | 2/1980 | Harvey | 354/330 |
| 4,332,456 | 6/1982 | Kaufmann | 354/299 |
| 4,350,429 | 9/1982 | Slavin | 354/299 |
| 4,497,559 | 2/1985 | Maris et al. | 354/330 |
| 4,754,298 | 6/1988 | Nishimoto | 354/299 |
| 4,780,737 | 10/1988 | Kobayashi et al. | 354/299 |

*Primary Examiner*—A. A. Mathews

*Attorney, Agent, or Firm*—Jordan B. Bierman

[57] ABSTRACT

An automatic developing apparatus suitable for processing an imagewise exposed disk film and a method using the apparatus are disclosed. The developing apparatus has a temperature controlling means for maintaining the temperature of processing solutions within a predetermined range with a means for automatically initiating the operation of said temperature controlling means after the main switch of the apparatus is turned on and either a predetermined amount of the processing solution is supplied into said bath or the liquid surface of the processing solution in said bath is at reaches a predetermined level.

7 Claims, 7 Drawing Sheets

AUTOMATIC PROCESSOR

FIELD OF THE INVENTION

The present invention relates to an automatic processor (or automatic developing apparatus) suitable for processing light-sensitive photographic materials (roll films or disk films), in which number to be processed at one time is as small as one to ten roll(s) or sheet(s).

BACKGROUND OF THE INVENTION

Disk films are furnished in the form of a film unit loaded in a cartridge, which are set in a camera exclusively used therefor, and, after photographs are taken, they are collected through agents to a centralized photographic processing facility, called a photofinishing laboratory, where photographic processing such as developing or printing is carried out.

In the photofinishing laboratory, the disk films are taken out from the cartridge by use of a cartridge opener, and a large number of films are set in a large-scale automatic processor at one time, which are processed while being rotated at a high velocity.

With regard to the photographic processing of disk films, disclosures are seen in U.S. Pats. No. 4,112,453, No. 4,132,469 and No. 4,188,106; in regard to the cartridge opener, Japanese Patent Publication Open to Public Inspection (hereinafter referred to as Japanese Patent O.P.I. Publication) No. 110829/1978, and U.S. Pats. No. 4,208,116 and No. 4,248,564; and in regard to their general matters, The Full View of Kodak disk film System [SHASHIN KOGYO (Photographic Industries), April Issue, 1982, pp.26–41].

The above are concerned with large-scale automatic processors, but automatic processors for use in the processing of disk films in numbers of one to ten sheets include those disclosed in Japanese Patent O.P.I. Publications No. 159146/1987, No. 178967/1987, No. 79018/1986, No. 143552/1988 and No. 273858/1988, filed by the present applicant.

In the case of the large-scale automatic processors or relatively small-sized automatic processors called minilabs (miniature photofinishing laboratories), processing solutions are stored in processing tanks or baths, and heated to a given temperature by means of a heater provided therein. In the processing baths, liquid level sensors are provided so that replenishing solutions previously heated may be supplied when processing has been carried out in a given quantity, lowering the liquid levels.

For example, in the case of small-sized automatic processors in which processing solutions are used in an amount of from several m1 to 1 l, the amount of processing solutions are reduced by evaporation and the deterioration of processing solutions is promoted by oxidation or the like when the processors left to stand for a long time, resulting in loss of stable processing performance when processing is resumed, irrespective of whether the processors are of the type in which processing solutions previously heated are supplied into processing baths, the type in which processing solutions are heated after they have been supplied into processing baths, or the type in which both of these types are used in combination.

This may remarkably occur when the capacity of processing baths is set to as small as about 1 ml to about 100 ml so that rapid processing can be carried out at high temperatures of, for example, about 40° C. or more, and it is very difficult to have a processor ready for use with stable processing solutions.

In instances in which processing solutions are put into inconstant intermittent use without any preset use or non-use of the processor, it is also very difficult to maintain the processing solutions in a stable state.

SUMMARY OF THE INVENTION

The present invention was made on account of the above, and a principal object thereof is to manifest a small-sized automatic processor provided with feeding and discharging mechanisms so that processing can be carried out with stable processing solutions. Other objects and advantages of the present invention will become apparent from the following descriptions and accompanying drawings.

The present invention that can achieve the above objects is characterized by an automatic processor having a means for controlling temperature of a processing bath, comprising;

a means for supplying a processing solution into an empty processing bath upon switching-on of the apparatus, until the solution reaches a predetermined amount or a predetermined liquid level, a means for automatically initiating temperature control on the processing bath after the processing solution has been supplied into the empty bath; and a means for discharging the processing solution from the processing bath.

More specifically, the present invention is characterized by an automatic developing apparatus for processing a photographic material comprising;

a processing bath in which a processing solution is put and said photographic material is processed with said solution;

a means for controlling temperature, said means being attached to said processing bath;

a means for automatically initiating the operation of said temperature controlling means after the main switch of the apparatus is turned on and either a predetermined amount of the processing solution is supplied into said bath or the liquid surface of the processing solution in said bath reaches a predetermined level; and a means for discharging said processing solution.

In a preferred embodiment of the present invention, the processor comprises a means to feed water or hot water to the processing bath made empty after the processing solution has been discharged.

Figure 1:
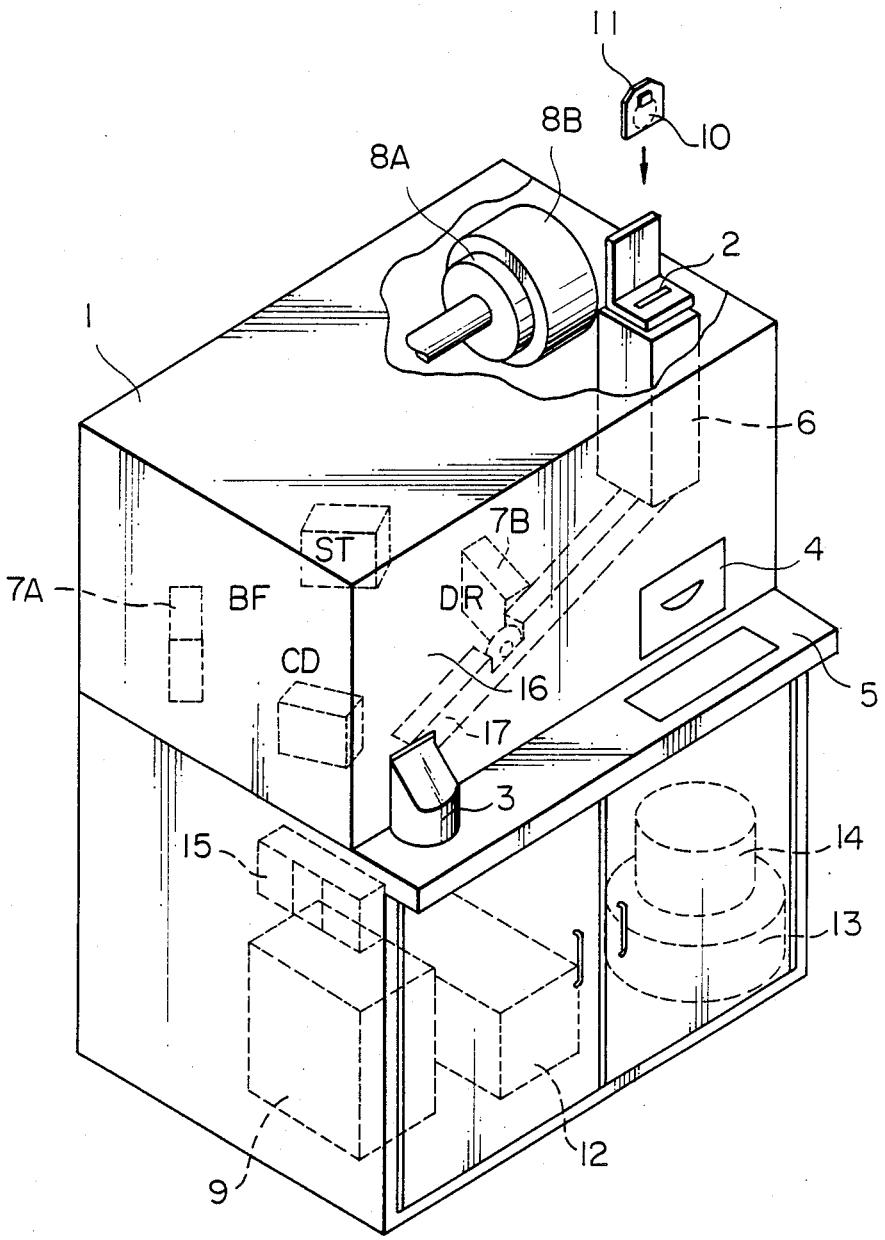
FIG. 1 is a schematic perspective view to illustrate an embodiment of the automatic processor to which the present invention is applied.

In the drawings, each numeral denotes the following:

1: Main body housing
2: Cartridge slot
3: Film exit
4: Empty cartridge stocker
5: Pedestal
6: Cartridge opener
7A: Processing bath
7B: Drying section
8A: Heater
8B: Fan
9: Processing solution tank
10: Disk film
11: Cartridge
12: Waste solution tank
13: Air compressor
14: Air tank
15: Solution feed pump
15: Starting point
17: Guide path member
20: Cartridge slot
21: Guide path
22: Shutter
23: Stopper
24: Holder
25: Opening pin
27: Stopper
28: Pusher
29: Air cylinder
30: Sensor
31: Sensor
32: Sensor
40: Starting point
41: Spindle
42: Shaft release member
43: Air cylinder
44: Collar
45: Lifter
46: Shaft
47: Motor
48: Motor
49: Receptacle
50: Air nozzle
51: Heater
52: Temperature sensor
53: Surface level sensor
54: Temperature controlling unit
55: Pipe for overflow
56: Processing bath
57: Pump for circulating a processing solution
58: Pipe for circulation
59: Pipe for replenishing a processing solution
60: Valve for drainage
61: Pipe for drainage

DETAILED DESCRIPTION OF THE INVENTION

The present invention will be described below in detail with reference to the accompanying drawings.

FIG. 1 schematically illustrates an example in which the present invention is applied in a small-sized automatic processor for use in disk films. A disk film 10 to be processed is inserted into a cartridge slot 2 in the state that it is loaded in a cartridge 11. The cartridge 11 is opened with a cartridge opener and the disk film 10 is taken out therefrom. The disk film 10 thus bared is fed to a processing system along a guide path 21. The cartridge 11 which became empty is released from the cartridge opener 6 and discharged into a stocker 4.

The numeral 5 denotes a pedestal, provided with a door and in which a processing solution tank 9, a solution feed pump 15, a waste solution tank 12, an air compressor 13 and so forth are disposed.

The numeral 7A denotes a processing bath. The processing bath includes those having the structure of the type in which, as illustrated in the drawing, separate processing baths are arranged for each kind of processing solution, or of the type in which the processing solutions are successively supplied into a single processing bath. The present invention can be applied to both of them.

The numeral 7B denotes a drying section. Air heated with a heater 8A is fed to the drying section 7B by the operation of a fan 8B through a guide tube.

The disk film 10 on which the processing has been completed is discharged through the exit 3.

The processing solutions to be used are received in a tank 9 and made ready for use, which are supplied into the respective processing baths by utilizing a pump or the like.

The temperature control of the processing solutions may be made in various manners, including an embodiment in which the processing solutions are heated before they are received in the tank 9, an embodiment in which they are heated while they pass through a feed pipe, an embodiment in which they are heated when they have been supplied into the processing baths, and an embodiment in which any of these are combined.

In the small-sized automatic processor as described above, the volume of the processing solution used in carrying out the processing is so small that the heat may be taken away in the course of the processing, making it very difficult to maintain the processing temperature.

Now, in the automatic processor illustrated in the drawing, the air inside the apparatus is heated with, for example, a heater and a fan so that the factor of the lowering of the processing solution temperature can be eliminated.

The heater and fan to heat the air inside the apparatus may not necessarily be always operated, but may preferably be controlled in the manner that they are operated only for a given time upon switching-on and stopped when temperature sensors, disposed preferably at plural positions, detect that the air inside the apparatus have reached a given temperature. They are then so controlled as to be restarted to operate when it is lowered to a given temperature.

The heater may comprise a nichrome wire, or may comprise a processed or molded heater such as a cartridge heater, a quartz heater, a Teflon heater, a rod heater and a panel heater, or a microwave, a far infrared heater, etc.

In another embodiment, heated air is guided by use of a guide tube and blown on the portions, such as a processing solution feed pipe, processing baths and so forth, in which the processing solutions come into contact with materials constituting such portions and the temperature is lowered. The air is blown so as to be appropriately scattered inside the apparatus. According to this embodiment, the capacity of the heater can be more reduced from the case when the entire air in the apparatus is heated, bringing about energy conservation.

In the automatic processor illustrated in the drawing, the respective processing sections are disposed in a radial fashion, and so constructed that the disk film 10 to be processed may be engaged with a spindle at a starting point 16, subjected successively to color developing (CD), bleach-fixing (BF), washing or stabilizing (ST) and drying (DR), and, when turned back again to the starting point 16, released from the spindle and discharged outside the apparatus through a guide path member 17.

The CD tank, BF tank and ST tank used may each have a small capacity preferably of 100 ml or less, and more preferably 30 ml or less, but may each not necessarily have the same capacity.

The respective tanks are connected with pipes through which the processing solutions are supplied from the processing solution tank by, for example, operating a bellows pump or the like, and equipped with a liquid level sensor to check the amount of fed or remaining solution, a heater to regulate temperature, a discharge valve, a discharge pipe, etc.

Figure 11:
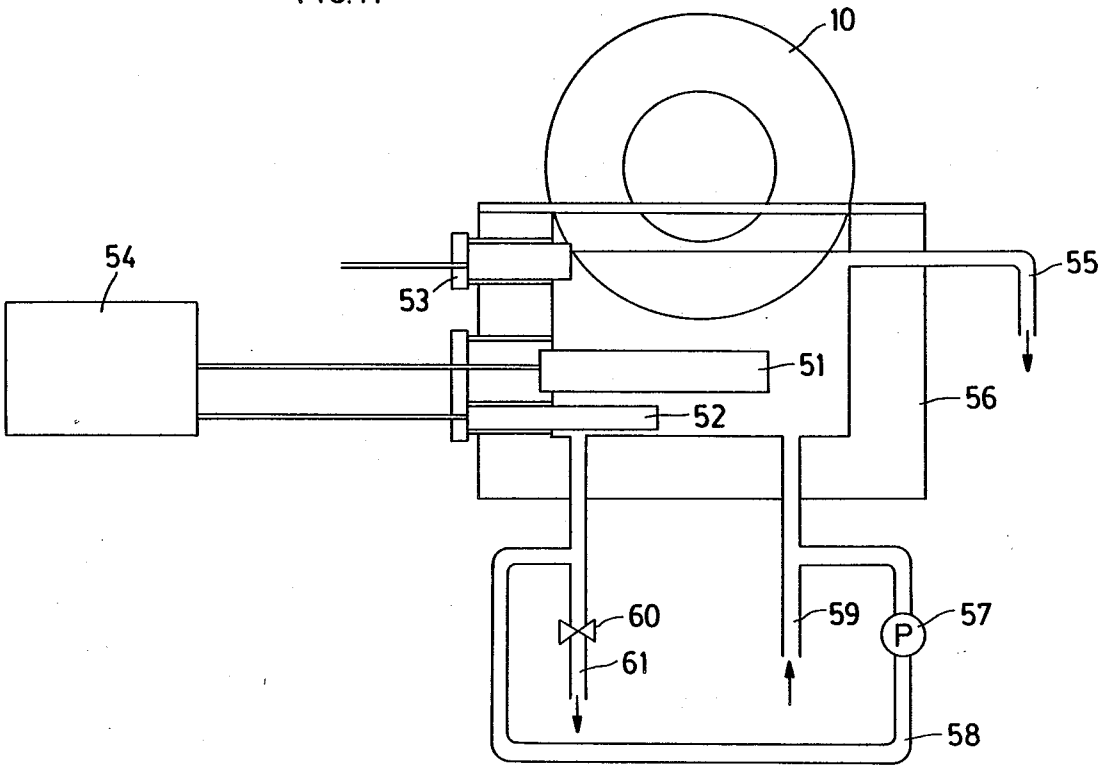
FIG. 11 is a schematic drawing showing the built in heater unit with its sensor and control.

Referring more specifically to FIG. 11, disc film 10 is suspended in processing bath 56. Temperature sensor 52 registers the temperature of bath 56 and actuates temperature control unit 54 which, in turn, turns on heater 51 when the temperature of the bath drops below the present level. Bath 56 is also provided with surface level sensor 53 which controls the replenishing of processing liquid through pipe 59. Overflow pipe 55 allows the processing liquid to flow out into a suitable reservoir (not shown). Pump 57 circulates the processing solution through pipe 58. Drainage valve 60 and drain pipe 61 permit emptying bath 56 when desired.

The processing solutions are supplied to the processing baths before processing is started, and preferably at the stage when a main switch of the apparatus is turned on, and the heating by the heater is effected in the processing baths section. When the temperature sensors detect that the temperature has reached a given degree, the disk film 10 at the starting point 16 or in stand-by at a stage anterior thereto is chucked on the spindle and first guided to the CD tank. After color developing is carried out preferably for about 1 minute, the disk film 10 is lifted up with a lifter, and guided to the next BF tank. At this stage, if another disk film 10 is engaged with a precedent spindle and is in the course of bleach-fixing, the disk film 10 is made to stand by until the processing solution in the precedent processing is discharged and the supplying of a new solution and the temperature control are completed. The bleach-fixing is preferably carried out for the same period of time as the color developing. The same applies to the subsequent steps.

When the bleach-fixing has been completed, the disk film 10 is moved to the ST tank, where the respective solutions may be exchanged to carry out washing twice for 30 seconds.

In the next drying step, air squeegeeing is first carried out by blowing air from a compressor 13, to remove the washing solution from its surface, and thereafter warm air is blown thereon to effect drying. At this stage, like other steps, the disk film 10 is rotated as in other steps.

The disk film 10, on which drying has been completed and which has been returned to the starting point 16, is then released from the spindle, and discharged from the film exit 3 through the guide path 21.

When the main switch is turned on, the processing solutions are supplied into the empty processing baths until they reach a predetermined amount or predetermined liquid level If, however, the button to start the processing is not placed in the on state after a predetermined period of time (waiting period), the processing solutions in the processing baths are discharged and the processing baths are made empty.

The above operation is made when the main switch is turned off, or also by a manual operation of pushing a button to discharge processing solutions.

In determining the stand-by period of the apparatus, there may be differences depending on the processing temperature is to be set and also on environmental temperature and humidity, but, if the temperature of the processing solutions kept standing by is not more than 40° C., the processing solutions in the processing baths may preferably be discharged in about 3 hours as a standard.

More preferably, water may be kept fed in the empty processing bath, which water may preferably be hot water, and more preferably hot water with a temperature higher than, or equal to, the processing temperature. The feeding of water or hot water prevents processing solution components from being deposited in the processing baths and in addition makes it easier to make temperature control when the processing is again started.

In the instance where water or hot water is stored in this way, the water or hot water may preferably be discharged when the processing solutions are supplied, but part or the whole thereof may also be left so that concentrated solutions or powdery or particulate processing components may be supplied.

Next, a more preferred embodiment of the automatic processor of the present invention will be further described in detail with reference to FIGS. 2 to 7.

Figure 2:
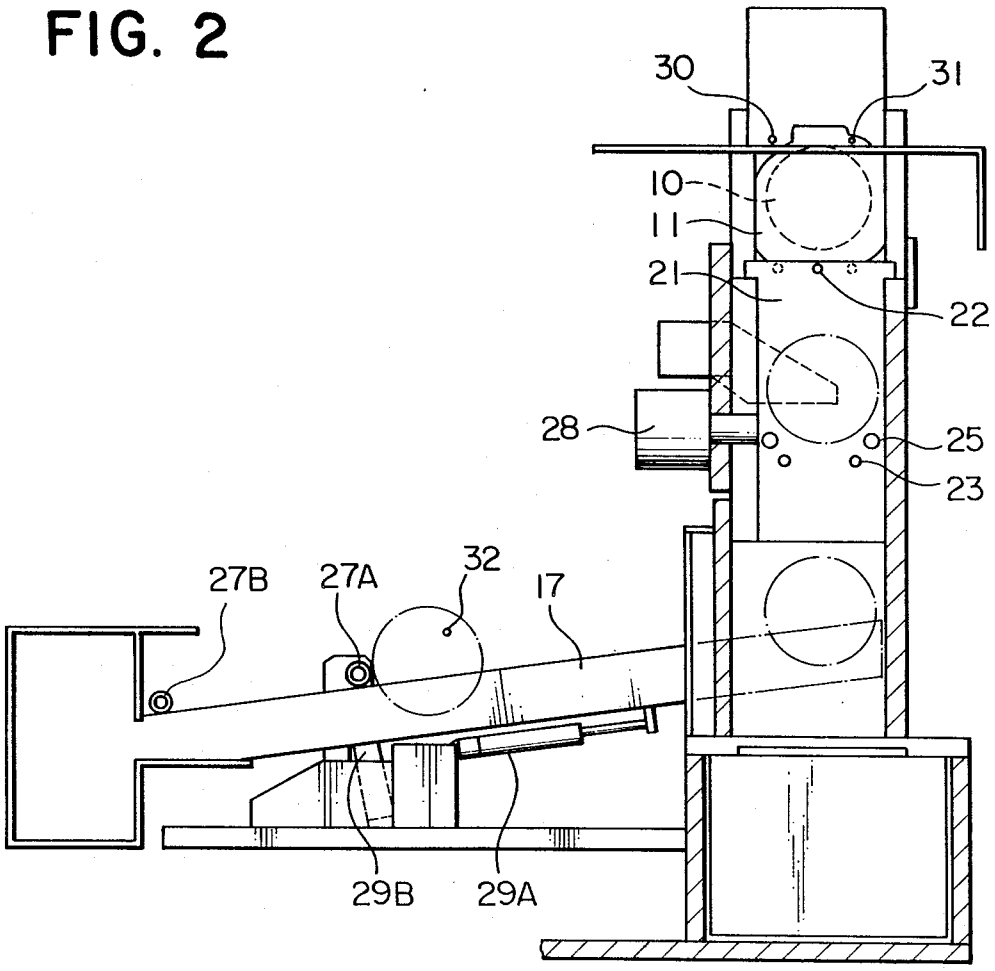
FIG. 2 is a sectional front elevation of part of a mechanism to out a disk film.
Figure 3:
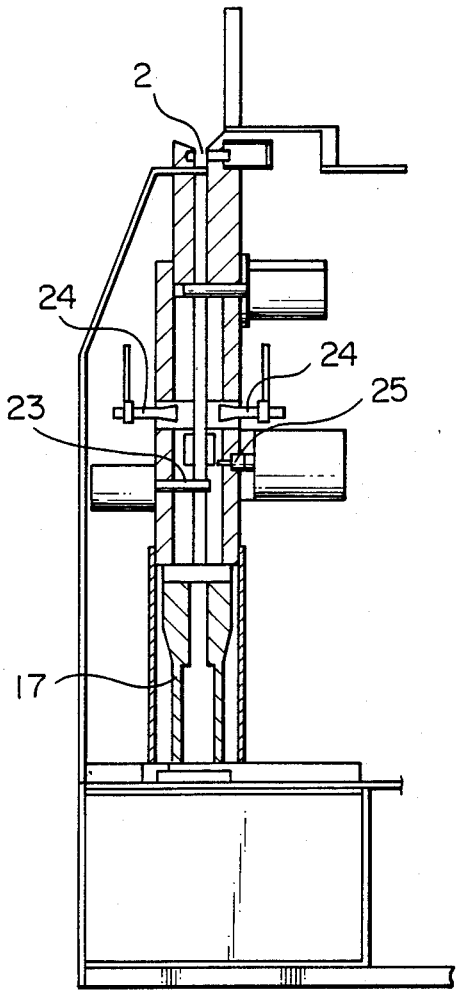
FIG. 3 is a sectional side elevation of the same part.

With reference to FIGS. 2 and 3, description will be first made on the steps in which the cartridge is set and the disk film is taken out.

The cartridge 11 holding therein the disk film 10 to be processed is, as shown in FIG. 2, inserted into the guide path 21 through a cartridge slot 2. At this stage, the guide path 21 is kept closed by means of a shutter 22, and the cartridge 11 is, as shown in the drawing, kept standing by at an upper part of the guide path 21, and at the same time its setting posture is checked.

The setting posture is checked in the following manner: The numerals 30 and 31 denote infrared sensors, and, when the sensor 30 shows no output and the sensor 31 shows an output after an input has been made about the information on the setting of the cartridge 11, the cartridge is judged to be correctly set. When the sensors show the outputs to the opposite or both sensors show no output, the cartridge is judged to be wrongly set, so that a notification is made by sound, light or the like. The sensors 30 and 31 are provided at the positions corresponding to the corners of the cartridge 11. More specifically, since the cartridge 11 commercially available has a large cutout on only one corner, detecting the position of this part makes it possible to confirm any mis-setting of the cartridge 11.

Now, once it has been confirmed that no cartridge 11 is present in the subsequent step and also that the cartridge 11 has been correctly set, the shutter 22 is opened and the cartridge 11 naturally drops through the guide path 21 to the position at which it comes into touch with a stopper 23, there the shutter 22 is closed synchronously therewith to keep the guide path 21 in the light-intercepted state.

With this state, a pair of holders 24 and 24 move in the opposed directions until some of their tips are engaged with the central aperture of the cartridge 11 to hold the cartridge 11, and when the holding is completed the stopper 23 returns to its original position, so that the lower part is made open. Subsequently, opening pins 25 and 25 move until they pass through apertures arranged at the bottom corners of an exposure window side plate of the cartridge 11 to force out a label side plate at the opposite side, thus destroying the joint at the bottom of the cartridge 16.

With the above state, a pusher 28 is operated to repeat pressing and removal of pressing on the side of the cartridge 11, whereupon the cartridge 11 is so deflected as to become open at its bottom, and thus the disk film 10 received therein naturally drops through the guide path 21 and tumble down along a guide path member 17 until it is engaged with a stopper 27A to come into the stand-by state.

Reaching this state is detected by a sensor 32. Completion of the takeout of a normal disk film 10 can be confirmed by counting the time from the start of the operation of the cartridge opener up to the detection by the sensor 32. If no detection is made by the sensor 32, the cartridge opener is again operated. If no disk film 10 can be taken out even after the operation is repeated given times, the holders 24 and 24 are removed to release the cartridge 11, which is collected in a dark box and treated separately.

Upon completion of the takeout of the disk film 10, the holders 24 and 24 are removed like the above case when the jam occurred, and the empty cartridge 11 is allowed to naturally drop into a stocker.

At the stage where the empty cartridge 11 is dropped, the guide path member 17 is made to run off in the left direction on the drawing by the operation of an air cylinder 29B to keep the guide path 21 in the open state. Another air cylinder 29B is provided to vibrate the guide path member 17, and the guide path member 17 is provided in a somewhat inclined fashion, where measures are taken so that the disk film 10 can be further surely moved.

The guide path member 17 may comprise a long, single U-formed member, but in the instance shown in the drawing it comprises joined two members so that only one of them may be moved.

The stopper 27 may be made to run off and concurrently the air cylinder 29B may be operated to vibrate the guide path member 17, so that the disk film 10 kept standing by is tumblingly moved in the left direction on the drawing to the position at which it is stopped with a stopper 27B (i.e., the starting point).

Figure 4:
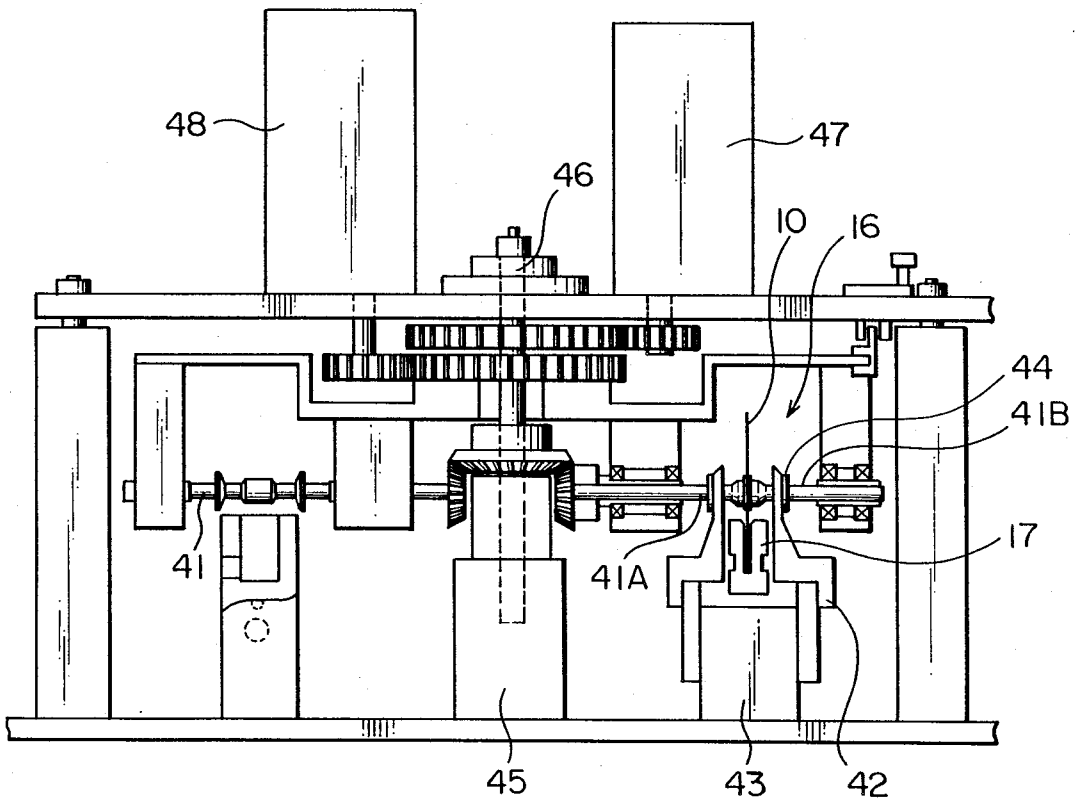
FIG. 4 is a cross-sectional view of a processing section.

The processing system will be described below with reference to FIGS. 4 and 5.

Figure 5:
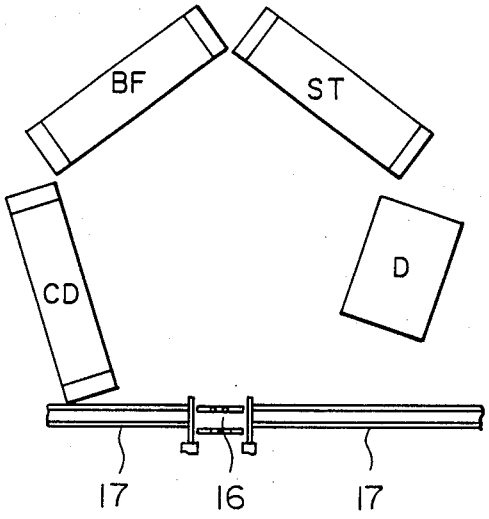
FIG. 5 is a schematic plan view of a processing system.
Figure 6:
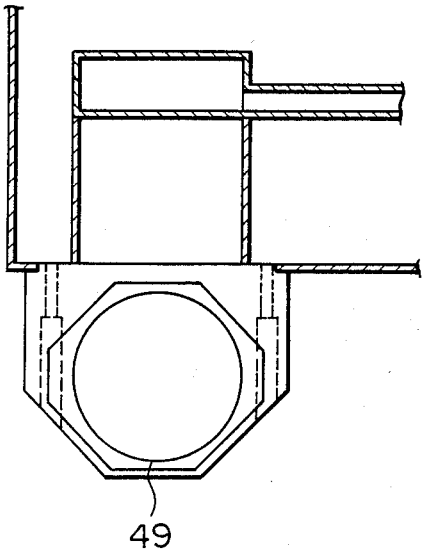
FIG. 6 is a transverse sectional view of an outlet from which the film is taken out.
Figure 7:
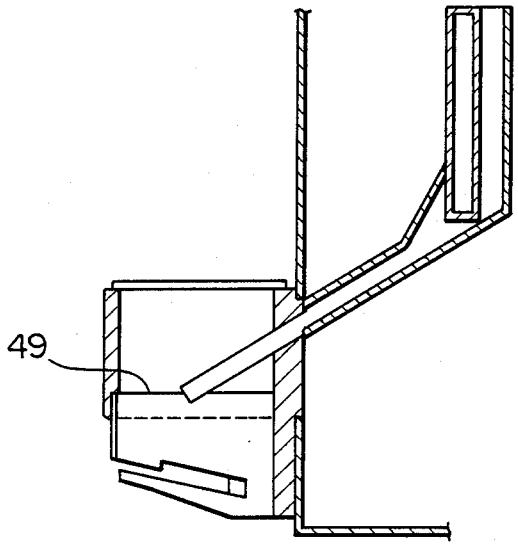
FIG. 7 longitudinal sectional view of the same.

In the automatic processor illustrated in the drawing, the respective processing sections are disposed in a radial fashion as shown in FIG. 5, where the disk film 10 to be processed is engaged with the spindle at the starting point 16 (the position at which the stopper 27B in FIG. 2 is located), subjected successively to color developing (CD), bleach-fixing (BF), washing or stabilizing (ST) and drying (DR), and, when turned back again to the starting point 16, released from the spindle and discharged outside the apparatus through the guide path member 17.

The spindle 41 that holds the disk film 10 is constituted of linearly opposed two shafts 41A and 41B, and the both shafts are pressed with each other by means of springs or the like in the direction in which their tips come into touch. It has the structure that one shaft 41A thereof has a convex tip and the other shaft 41B has a concave tip so that the tip of the shaft 41A may come into the concave of the tip of the shaft 41B to some extent. Accordingly, the tip of the shaft 41A may be inserted to part of a round aperture at the central core if the disk film 10, which can be inserted without any problem even if it deviates from the center, so that the disk film 10 can be kept always engaged with the spindle 16 at its center.

There is provided at the starting point 40 a mechanism to release the engagement of the shafts 41A and 41B that constitute the spindle 41. More specifically, as illustrated in FIG. 4, there are provided a pair of shaft release members 42 provided at their tops with substantially U-formed cutouts to be respectively engaged with the shafts 41A and 41B, and an air cylinder 43 may be operated to move the shaft release members 42 in the opening direction, so that the tops come into touch with collors 44 provided on the shafts 41A and 41B and then the shafts 41A and 41B are moved in the opening direction against the force of the springs which press them.

With the above state, the stopper 27A may be made to run off, thereby making the standing-by disk film 10 to move to the starting point 16, and the air cylinder 43 may be stopped operating, so that the shafts 41A and 41B return to the opposing direction to chuck the disk film 10.

The disk film 10 which has been processed and has returned to the starting point 40 can be released from the spindle 41 by reversing the above actions. More specifically, the lifter 45 may be operated to lower the spindle 41 to a given depth, so that the shafts 41A and 41B of the spindle 41 are engaged with the U-formed cutouts on the tops of the shaft release members 42, and subsequently the air cylinder 43 may be operated, so that the shafts 41A and 41B are separated, and the disk film 10 held between them naturally drops into the groove of the guide path member 17, which is then tumblingly discharged outside the apparatus.

The spindles 41 are disposed in a radial fashion via bearing members fixed to arms or discs, and gears fixed to their base portions are engaged with a gear fixed on a shaft 46, which are driven by a film-rotating motor 47 and rotated at about 50 to 400 rpm.

The numeral 48 denotes a motor to move the disk film 10, by which the arms or discs supporting the spindles 41 are made to circle at given intervals (by 72 degrees in the embodiment illustrated in the drawing), thereby successively guiding the disk film 10 to the respective processing sections.

In operating the motor 48, the lifter 46 must be beforehand operated to make the spindle 41 (i.e., the disk film 10 held by it) upward run off.

To stop the moving disk film 10 at a correct processing position, various positioning means are used, as exemplified by the detection of position with use of a sensor, the computation of revolution number or revolution angle, the counting of operation time, etc.

The CD tank, BF tank and ST tank used may each have a small capacity preferably of 100 ml or less, and more preferably 30 ml or less, but may each not necessarily have the same capacity.

The respective tanks are connected with pipes through which the processing solutions are supplied from the processing solution tank by, for example, operating a bellows pump or the like, and equipped with a liquid level sensor to check the amount of feed or remaining solution, a heater to regulate temperature, a discharge valve, a discharge pipe, etc.

The processing solutions are supplied into the processing baths before the processing is started, and preferably at the stage when a main switch of the apparatus is turned on, and the heating by the heater is effected at the part of the processing baths. When the temperature sensors detect that the temperature has reached a given degree, the disk film 10 at the starting point 16 or in stand-by ar a stage anterior thereto is chucked on the spindle, and first guided to the CD tank. After color developing is carried out preferably for about 1 minute, the disk film 10 is lifted up with the lifter 45, and guided to the next BF tank by making the arm or the like to circle by the operation of the motor 48. At this stage, if another disk film 10 is engaged with a precedent spindle and is in the course of bleach-fixing, the disk film 10 is made to stand by until the processing solution in the precedent processing is discharged and the supplying of a net solution and the temperature control are completed. As mentioned hereinbefore, the bleach-fixing may preferably be carried out in the same period of time as the color developing, and the same applies to the subsequent steps.

In the drying step, before the blowing of dried warm air, a step is taken to carry out air squeegeeing by blowing air from a compressor, which serves as a power source to operate the respective mechanisms in the apparatus, to remove the washing solution from its surface. At this stage, the disk film 10 is rotated at a small revolution number (preferably at 500 rpm or less, more preferably from 50 to 400 rpm, and particularly preferably at the same revolution number as that in the developing step).

The blowing of compressed air may preferably be carried out at every stage before start of the drying step, immediately after its start, and in the course of the drying step.

Figure 8:
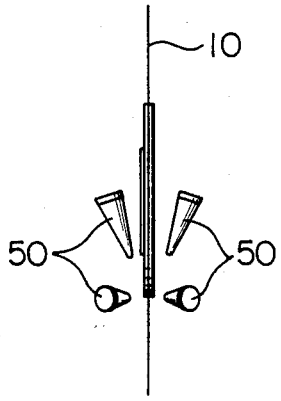
FIGS. 8, 9 and 10 are a front elevation, a side elevation and a plan view, respectively, to illustrate an embodiment of an air squeegeeing mechanism used in a drying section.
Figure 9:
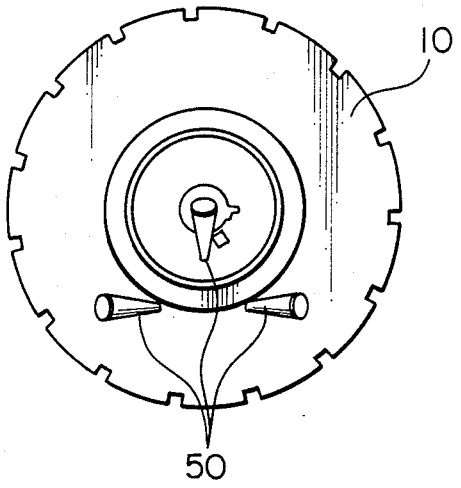
Figure 10:
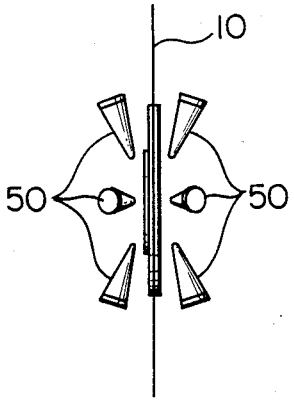

There are no particular limitations on the direction of blowing the compressed air (i.e., the direction of nozzles 50) with respect to the disk film surface, but it may preferably be in an angle of from 5 to 90 degrees, and particularly from 10 to 80 degrees (see FIGS. 8 to 10).

Also preferred is an embodiment in which the compressed air from the compressor is heated for its utilization as the dried warm air.

The disk film 10 on which the drying has been completed and which has been returned to the starting point 16 is released from the spindle by the operation of the mechanism previously described, and discharged through the guide path 21 into a receptacle 49 provided at the film exit 3 in such a way that it is overlapped in the order of the one having been processed.

In another preferred embodiment of the present invention, the processor comprises a mechanism to carry out continuous processing by making equal the time during which disk films stay in the respective processing sections for carrying out the steps of from color developing to drying, and synchronously transferring to subsequent steps the disk films to be processed.

In still another preferred embodiment of the present invention, the respective processing sections for carrying out the steps of from color developing to drying are disposed in a loop fashion such that the position at which a disk film is taken in and the position at which the taking-in of the disk film is released are the starting point and the terminal, respectively, and on the other hand the processor is provided with a mechanism in which a plurality of spindles that hold disk films through a chuck mechanism are circuited among the respective processing sections, which concurrently comprises the mechanism to carry out continuous processing by making equal the time during which disk films stay in the respective processing sections, and synchronously transferring to subsequent steps the disk films to be processed.

In this way, it becomes possible to carry out processing with a higher efficiency by guiding a sheet or plural sheets of disk films to the respective processing sections to carry out continuous processing.

According to still another embodiment of the present invention, the automatic processor of the present invention is equipped with an air compressor, provided with a tank to store compressed air, and has a mechanism to use the compressed air for operating the whole, or part, of the mechanism to take out a light-sensitive photographic material from a light-intercepting container, hold, rotate and carry the photographic material, and supply and discharge processing solutions.

More specifically, the compressed air from an air compressor 13 and an air tank 14 can be used for the whole, or part, of means for driving the mechanism to take the cartridge in the apparatus, make it to stand by and control the discharging of it when mis-setting occurred; means for driving the opener 6 to take out a disk film 10 from a cartridge 11, means for transferring the disk film 10 from the opener 6 to a processing system: means for chucking the disk film 10 on, or releasing the chucking thereof from, for example, a spindle in the processing system; means for transferring, rotating and vibrating the disk film 10 at the respective processing sections; means for supplying and discharging processing solutions; means for air squeegeeing in the drying step; etc.

In the driving mechanisms in which the compressed air is utilized, the air compressor 13 is driven by a motor or the like to keep the compressed air stored in the air tank 14, and this air tank 14 is kept connected through a pipe with terminal devices which perform rotation or reciplocation. The driving of these terminal devices is controlled by opening and closing, or switching, valves or the like controlled by an automatical control means utilizing, for example, microcomputors.

Preferably used as a feed pump 15 is a bellows pump which is operated by the compressed air.

One of the advantages obtained when the compressed air is utilized is that it can be utilized for the air squeegeeing, in which the moisture adhered to the surface of the disk film 10 can be removed by blowing thereon the compressed air. Moreover, the compressed air can be utilized in place of the warm air for drying, which has been conventionally generated by use of a heater and a fan. Such an embodiment is advantageous in that the fan becomes unnecessary.

A further great advantage obtained by utilizing the compressed air is that the air compressor 13 and air tank 14 can be disposed, for example, in a pedestal which is separated from the main body of the automatic processor. This is not only useful for making small the size of the main body of the automatio processor as compared with the case when an electrical motor must be disposed in the main body of the automatic processor because the system in which the electrical motor is utilized as conventionally done makes the driving system complicate and long, but also advantageous in that stable processing performances can be obtained since the processing temperature can be very appropriately controlled in the system in which the compressed air is utilized, as compared with the case that the processing temperature tends to be mis-controlled owing to the heat generated by the electrical motor.

What is claimed is:

1. An automatic developing apparatus for processing disk film housed in a light-shielded cartridge which comprises a pair of plastic sides, said apparatus comprising (1) means for opening said cartridge and dropping said disk film therefrom by peeling off a lower end of said cartridge while it is vertically supported;

(2) a plurality of processing baths comprising at least two of a color developing bath, a bleach bath, a fixing bath, and a stabilizing bath, and optionally a drying unit, each bath containing a processing solution;

(3) means for supporting horizontally disposed first spindles, each of said first spindles adapted to engage said disk film substantially at the center thereof and being arranged in a closed path passing over said processing baths, whereby said disk film is only partially submerged in said processing solution;

(4) means for moving said first spindles means from bath to bath at a predetermined interval and timing;

(5) means for rotating said disk film around the axis of said first spindles at a predetermined rotation speed during processing;

(6) means for detaching said disk film from said first spindles after the completion of said processing;

(7) means for automatically supplying said processing solutions to said processing baths in predetermined amounts or to predetermined levels in said baths and thereafter automatically starting operation of a heating means, after a main switch of the apparatus is turned on; and (8) means for draining said processing solutions.

2. The apparatus of claim 1 wherein amounts of said processing solutions supplied to each of said processing baths are each a maximum of 100 ml.

3. The apparatus of claim 2 wherein said amounts are each a maximum of 30 ml.

4. The apparatus of claim 1 wherein said disk film is dried in said drying unit by contacting said film with warm dry air.

5. The apparatus of claim 1 wherein said means for opening said cartridge comprises two second spindles oppositely disposed for supporting said cartridge, two pins for peeling off the lower end of said cartridge, and a pusher for exerting a force horizontally from one edge toward another edge of said cartridge whereby said sides are at least partially separated from each other thereby forming an opening at said lower end to permit said disk film to pass through, said second spindles having sufficient space therebetween for said disk film to pass through.

6. The apparats of claim 1 wherein less than half of said disk film is submerged in said processing solution.

7. The apparatus of claim 1 further comprising means for controlling temperature of said processing baths comprising sensors for measuring said temperatures, built in heating means for said processing baths, and a control unit therefor.

* * * * *